US010170841B1

(12) United States Patent
Tonn

(10) Patent No.: US 10,170,841 B1
(45) Date of Patent: Jan. 1, 2019

(54) DUAL MODE SLOTTED MONOPOLE ANTENNA

(71) Applicant: David A Tonn, Charlestown, RI (US)

(72) Inventor: David A Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 15/398,799

(22) Filed: Jan. 5, 2017

(51) Int. Cl.
*H01Q 13/10* (2006.01)
*H01Q 13/12* (2006.01)
*H01Q 1/48* (2006.01)

(52) U.S. Cl.
CPC ..... *H01Q 13/12* (2013.01); *H01Q 1/48* (2013.01)

(58) Field of Classification Search
CPC ..... H01Q 13/12; H01Q 1/48
See application file for complete search history.

(56) References Cited

U.S. PATENT DOCUMENTS 4,451,830 A * 5/1984 Lucas ..... H01Q 21/205 343/768
2005/0116867 A1* 6/2005 Park ..... H01Q 9/0414 343/725

* cited by examiner

*Primary Examiner* — Dieu Hien T Duong
(74) *Attorney, Agent, or Firm* — James M. Kasichke; Michael P. Stanley

(57) ABSTRACT

A dual mode antenna can be joined to an antenna feed. The antenna includes a slotted cylinder radiator that can be connected to the first conductor of the antenna feed and an electrically conductive ground plane that can be connected to the second conductor. The radiator axially extends perpendicularly from the ground plane and is electrically insulated therefrom. The first conductor can be joined to the radiator near one side of the slot. A reactive load is joined between the ground plane and the radiator near an opposite side of the slot. The reactive load impedes lower frequencies from the ground plane to the radiator. This allows the radiator to function as a monopole at lower frequencies and a slotted cylinder at higher frequencies.

19 Claims, 6 Drawing Sheets

DUAL MODE SLOTTED MONOPOLE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to a dual mode antenna having one mode as a slotted cylinder antenna and another mode as a monopole antenna.

(2) Description of the Prior Art

Slotted cylinder antennas are popular antennas for use in line of sight communications systems, especially where the carrier frequency exceeds 300 MHz. FIG. 1 provides a diagram of a prior art slotted cylinder antenna 10. Antenna 10 includes a metallic cylinder 12 having slot 14 cut into the wall of the cylinder 12. Cylinder 12 can be any thickness as long as skin effects are avoided. Slot 14 is parallel to an axis 16 of cylinder 12. Axis 16 is perpendicular to a conductive ground plane 18. In the antenna shown, slot 14 extends the entire length of the cylinder 12. The interior of the cylinder or cavity is typically filled with air but another dielectric material such as syntactic foam can be used. FIG. 1 shows an end-fed version of this antenna, but this antenna can also be center-fed. In the end-fed version, an antenna feed having a first conductor 20 is provided through the ground plane 18 and connected to one side of the slot 14 near the end of the slot 14. A second conductor 22 is shown grounded to the ground plane 18 and connected to the other side of the slot 14. Transmission line can be either a balanced line, such as a twisted pair, or an unbalanced line, such as a length of coaxial line. In either case, the antenna feed has two conductors in order to connect across slot 14.

In U.S. Pat. No. 6,127,983 to Rivera and Josypenko, it has been shown that the slotted cylinder antenna has a cutoff frequency below which the slot mode of operation does not occur. This cutoff frequency is defined in terms of an equivalent electric circuit for the antenna in which the slot is represented by a per unit length capacitance and the circumferential loop formed by the cylinder by a per unit length inductance. This capacitance and inductance are used to compute the cutoff frequency in a manner similar to a resonant L circuit. The formulas governing this operation are as follows:

$$\varphi = \arcsin\left(\frac{w}{2a}\right); \tag{1}$$

$$Z = 1 + 10\left[\frac{\pi t}{w} + \left(\frac{\varphi}{6}\right)^2 + 2(1 - \ln(\varphi))\right]; \tag{2}$$

-continued $$k = \frac{1}{a}\frac{\sqrt{1+10Z}-1}{Z}; \text{ and} \tag{3}$$

$$f = \frac{kc}{2\pi}. \tag{4}$$

Here, the slot width is w, the thickness of the wall of the cylinder is t, c is the speed of light, and a is the radius of the cylinder. The frequency f is computed in Hertz. When operated above this cutoff frequency, the slot supports an electric field that produces radiation in the far field zone of the antenna. When operated below this cutoff frequency, it does not.

FIG. 2 shows a VSWR plot for the prior art antenna of FIG. 1. The antenna tested was a 12 inch slotted cylinder antenna. A low frequency resonance 24 is indicated at 259 MHz. This conforms to antenna theory which indicates that a 12" antenna acting as a quarter wave monopole should have resonance near 245 MHz. If the antenna were truly operating as a monopole, the VSWR at the low frequency resonance 24 should be much lower. Shorting out the antenna at the feed prevents resonance at the monopole mode. Resonances at 26 and 28 are higher order modes of the antenna from its performance as a slotted cylinder.

It may be desirable to have an antenna such as this that is capable of radiating at a different frequency below this cutoff. The present invention provides a means by which the overall antenna structure can radiate as a monopole below the cutoff frequency without interfering with normal slot mode operation above this frequency.

SUMMARY OF THE INVENTION

It is a first object of the present invention to provide a compact antenna capable of transmitting and receiving.

Another object is to provide such an antenna being capable of radiating as a slotted cylinder antenna.

Yet another object is to provide an antenna design that can also radiate at frequency below the slotted cylinder cutoff frequency.

Accordingly, there is provided a dual mode antenna that can be joined to a two conductor antenna feed. The antenna includes a slotted cylinder radiator that can be connected to the first conductor of the antenna feed and an electrically conductive ground plane that can be connected to the second conductor. The radiator axially extends perpendicularly from the ground plane and is electrically insulated therefrom. The first conductor can be joined to the radiator near one side of the slot. A reactive load is joined between the ground plane and the radiator near an opposite side of the slot. The reactive load impedes lower frequencies from the ground plane to the radiator. This allows the radiator to function as a monopole at lower frequencies and a slotted cylinder at higher frequencies.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 3:
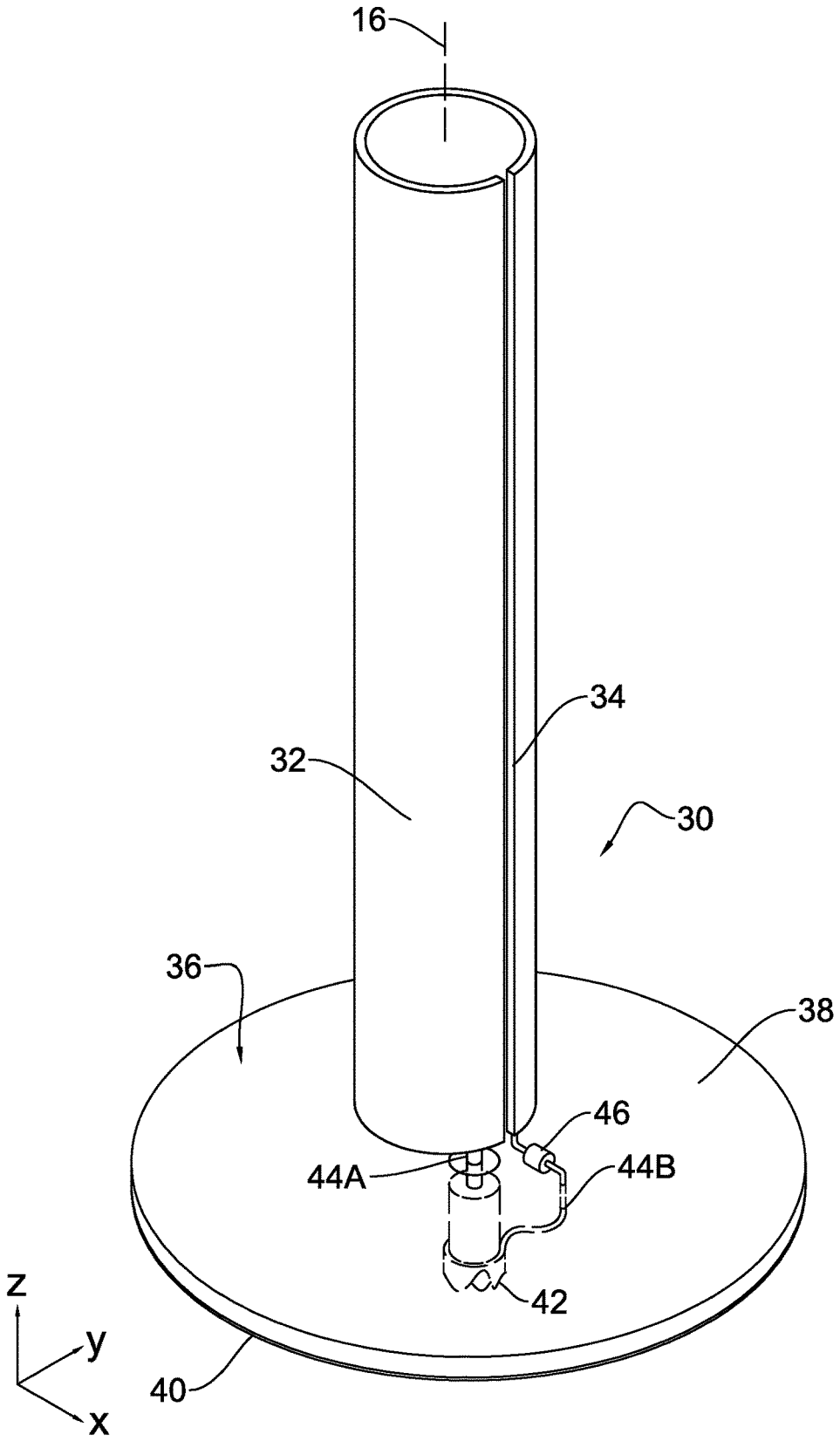
FIG. 3 is a perspective view of a first antenna embodiment in accordance with the current invention.

FIG. 3 shows an antenna 30 in accordance with a first embodiment. This embodiment includes a radiator which is cylinder 32 having a slot 34 formed longitudinally therein. Cylinder 32 is positioned above a ground plane 36 having a disk 38 of dielectric material. Ground plane 36 also includes a conductive foil 40 positioned on a bottom surface of disk 38. Many other conductive materials could be used for ground plane 40 including electroplated copper or a conductive plate. Disk 38 provides a support structure for conductive foil 40 and insulates cylinder 32 from foil 40. Disk 38 could be another structure such as a framework, and many other materials could be used for disk 38. Radius of disk 38 should be at least ¼ of the preferred operating wavelength in order to avoid adversely affecting input impedance. The thickness of disk 38 is dictated by the structural limitations of the material from which it is made and the need for electrical separation. The disk should be as flat as possible with minimal sagging under the influence of gravity. In testing, an acrylic resin material was used for disk 38.

Antenna 30 is joined to a feed 42 having two elements 44A and 44B. First element 44A is insulated from conductive foil 40 and joined to cylinder 32 on a first side of slot 34 at one end of cylinder 32. Second element 44B of feed 42 is joined to conductive foil 40. Conductive foil 40 is joined to cylinder 32 by a capacitor 46 on a second side of slot 34. Capacitor 46 is joined at the same end of cylinder 32 as first element 44A.

When this antenna is operated well below the cutoff frequency of the slot mode as taught by Rivera and Josypenko, the current on the left hand side of slot 34 (as viewed in FIG. 2) is nearly in phase with that on the right hand side of slot 34. This is because the circumference of the cylinder is less than 1/10 of a wavelength at the cutoff frequency. The phase difference that occurs as the current travels circumferentially around cylinder 32 is then negligible. Feed 42 experiences an extremely low impedance and is effectively shorted out. Little to no power is coupled into the antenna 32 as a result of this very low impedance.

Figure 2:
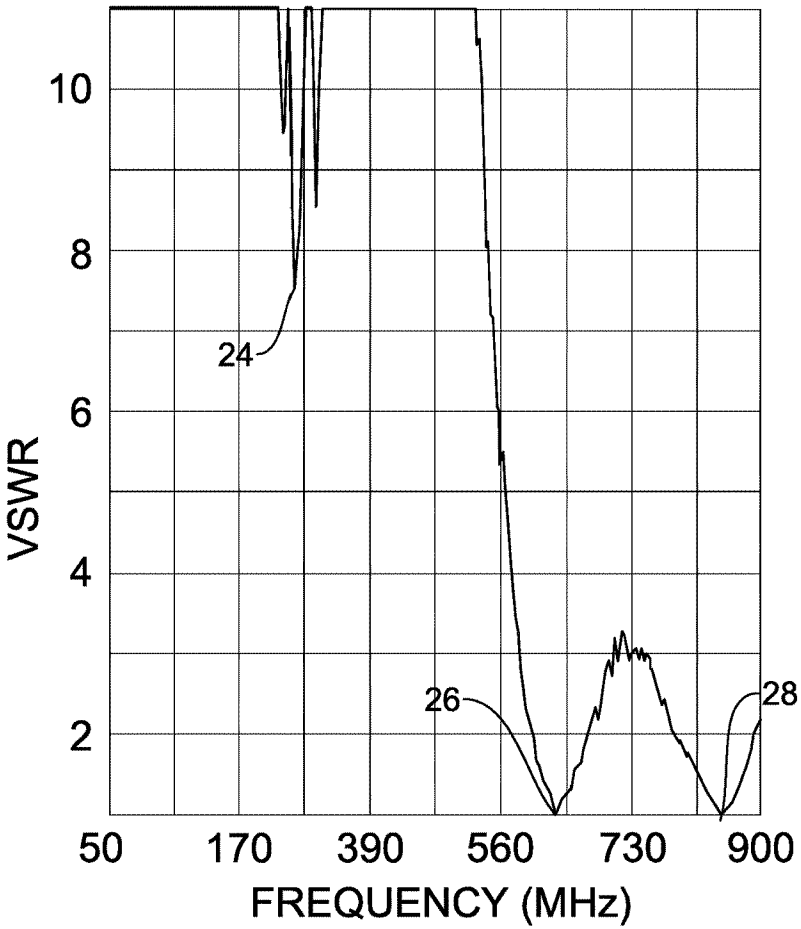
FIG. 2 (PRIOR ART)
FIG. 2 is a measured VSWR plot against frequency of the prior art antenna given in FIG. 1.

The embodiment shown in FIG. 2 resolves this impedance issue by connecting the right hand side of slot 34 as seen in FIG. 2 through a capacitor 46 to ground plane 40. The capacitance of capacitor 46 is chosen so that its impedance is high compared with the impedance of the feeding transmission line 42. (This is typically 5.0 Ohms.) Capacitor 46 prevents almost all of the current from flowing from the right edge of slot 34 to ground plane 40. In essence this floats the antenna 30 above ground 40. This allows the entire circumference of cylinder 32 to be at the same potential at a given height above ground plane 40, allowing it to function as a monopole antenna. In this way, the antenna structure is able to radiate at a lower frequency below than the normal frequency for a slotted cylinder antenna.

A prior art approach is to lower the cutoff frequency of the cylinder in order to improve performance. This can be done by loading the slot with dielectric material or by providing fins on the slot to increase its effective cross sectional area. These methods increase the capacitance of the slot (on a per unit length basis). Since the cutoff frequency is computed in a manner similar to the resonant frequency of an LC circuit (e.g., $f^2$~/LC), increasing this capacitance will decrease the resonant/cutoff frequency. Unlike the technique shown, these modifications will not prevent the feed region from shorting out at low frequencies.

A prototype of this embodiment consists of a 12" long copper pipe with a 1 inch inner diameter for use as cylinder 32. A 3/16" wide slot is provided in the wall of cylinder 32 as slot 34. Slot 34 is parallel to axis 16 of cylinder 32, as shown in FIG. 2. Cylinder 32 is vertically mounted on a 10" diameter disk 38 made from 0.22" thick acrylic. Cylinder 32 is positioned on the top surface of disk 38. (Cylinder 32 is retained on disk 38 surface by an L-bracket (not shown) soldered to the back surface of cylinder 32. The bracket was fastened to the ground plane 36 by means of a non-conductive nylon screw (not shown) in order to insulate cylinder 32 from foil 40. On the lower surface of disk 38, adhesive copper foil is used as the conductive foil 40, forming the ground plane assembly 36. In order to join feed 42, a standard 50 ohm BNC coaxial connector was fastened to the acrylic disk 38 on its lower surface so that its flange and the outer conductor 44B made electrical contact with the copper foil 40, grounding the system. The center conductor 44A of the coaxial connector protrudes through a hole in the acrylic disk 38 allowing it to connect to cylinder 32 without making electrical contact with foil 40. The center conductor connects 44A to the left side of the slot 34, as viewed from the front as shown in the detailed view in FIG. 2. The right side of the slot 34 is joined to foil 40 by a short wire and capacitor 46 connected to a conductive screw (not shown) holding the feed 42 to the ground plane assembly 38.

Figure 1:
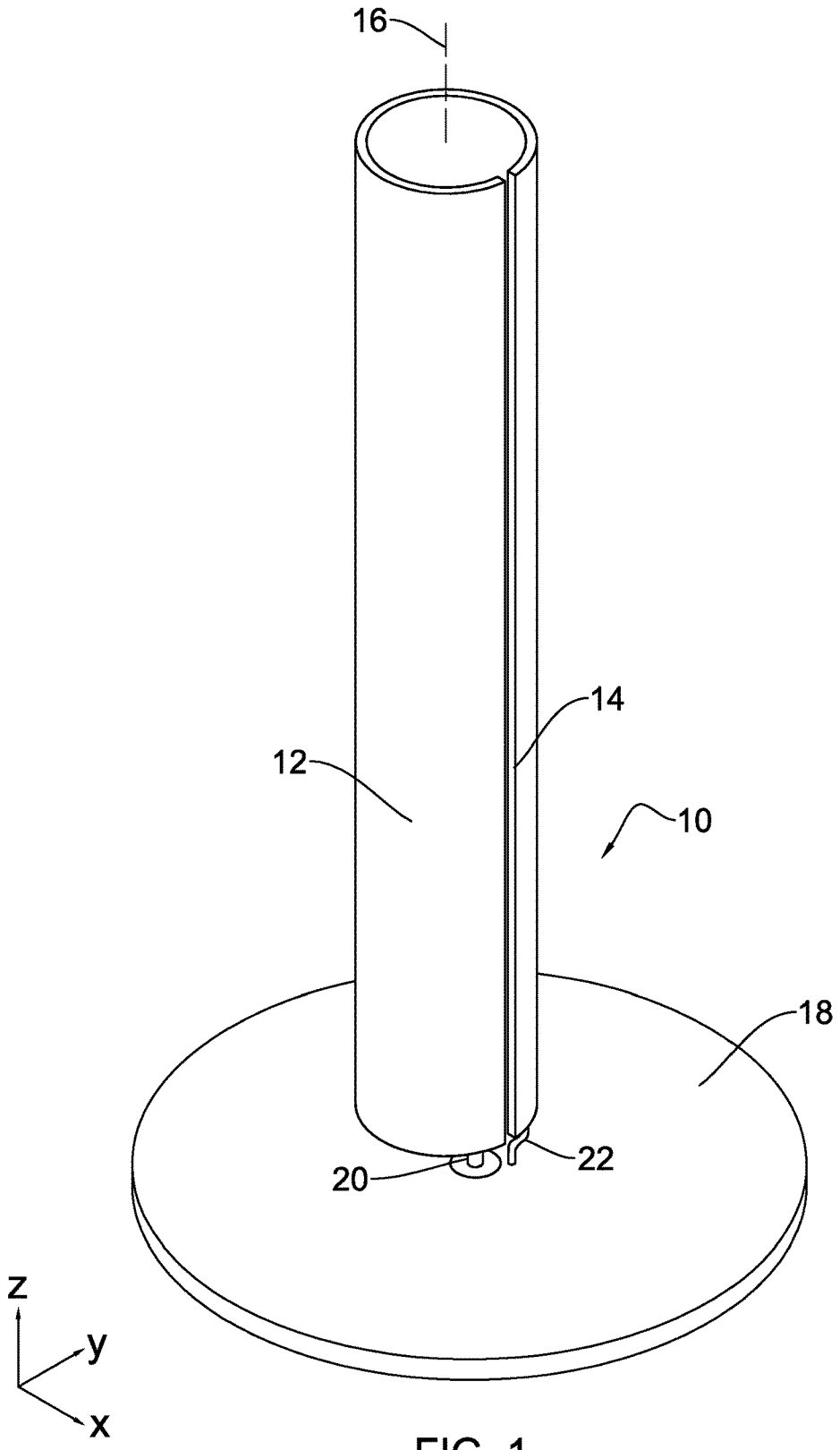
FIG. 1 (PRIOR ART)
FIG. 1 is a perspective view of a prior art antenna.
Figure 4:
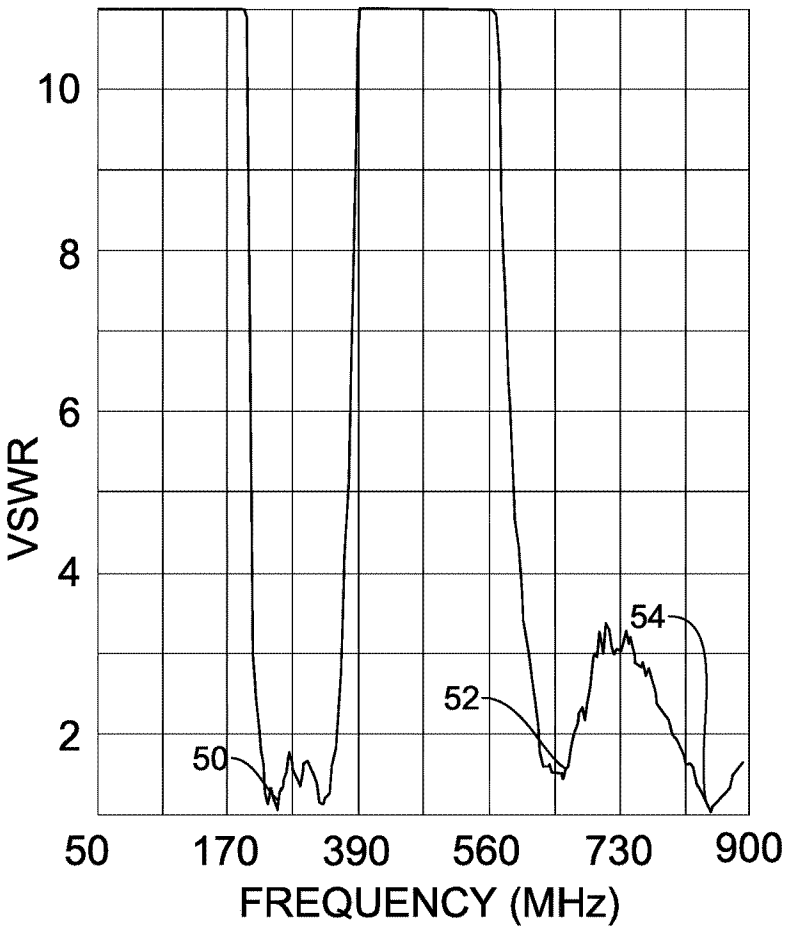
FIG. 4 is a measured plot of VSWR against frequency of the antenna embodiment shown in FIG. 3.

FIG. 4 provides a VSWR plot of antenna 30 after inserting capacitor 46 between the right side of slot 34 and the conductive foil 40.

The capacitance value for capacitor 46 was determined empirically. Initially, a 10 pF capacitor was used based on expected values of impedance required, but this had little effect. It was found that a large capacitance value, 680 pF, gave a better result. It is hypothesized that valid capacitance values could be in the range of 470 pF to 1500 pF; however, these values have not been confirmed by testing. With a 680 pF capacitor in place, the VSWR plot is given as shown in FIG. 4. The monopole mode gives a clear resonance 50 with a significant passband extending from 216 MHz to 339 MHz, a 123 MHz span or 57% bandwidth. This is unexpected for such basic antenna geometry. Normally such geometries have bandwidths of less than approximately 10% due to the resonant nature of the structure. Higher frequency, slotted cylinder resonances are shown at reference numbers 52 and 54.

Figure 6:
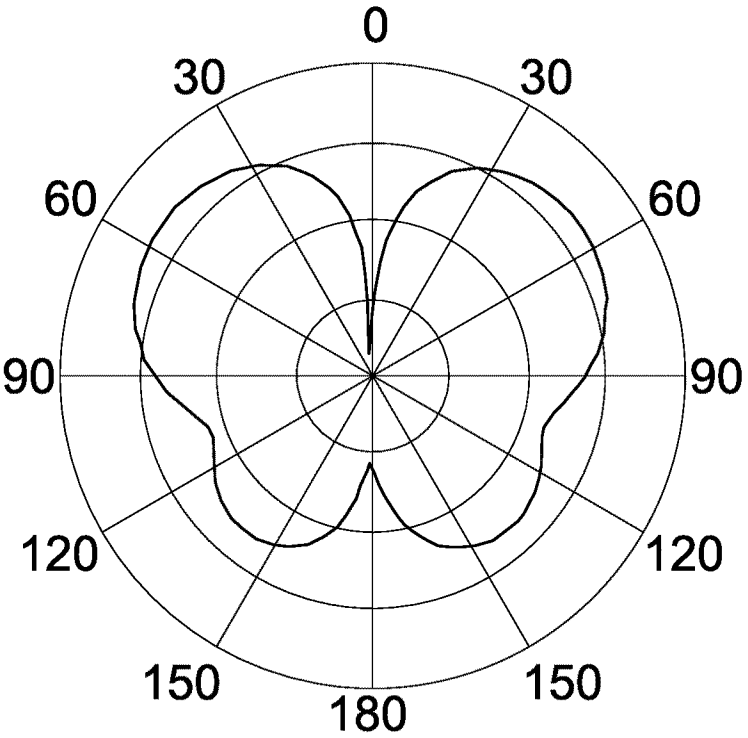
FIG. 6 is a modeled plot of the beam pattern of the antenna of FIG. 3 taken at 658 MHz.
Figure 5:
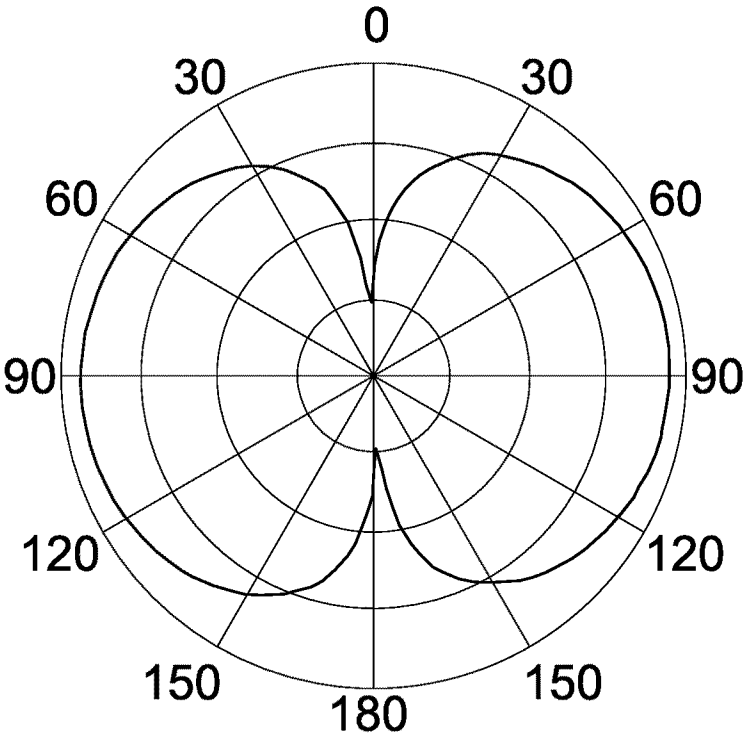
FIG. 5 is a modeled plot of the beam pattern of the antenna of FIG. 3 taken at 261 MHz.

FIG. 5 provides the computed radiation pattern of the antenna at 261 MHz, and FIG. 6 provides the computed radiation pattern of the antenna at 658 MHz. FIG. 5 is within the monopole mode band pass region. FIG. 6 is within the slotted cylinder mode band pass region. As can be seen, computed radiation patterns of the antenna remain well behaved in these pass band regions.

Figure 8:
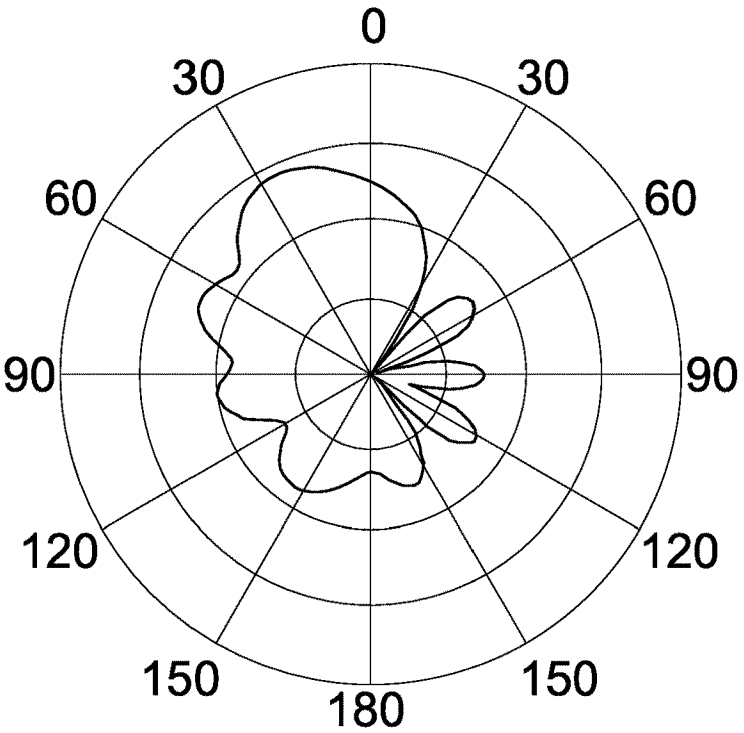
FIG. 8 is a modeled plot of the horizontal component of the beam pattern of the FIG. 3 antenna taken at 1850 MHz.
Figure 7:
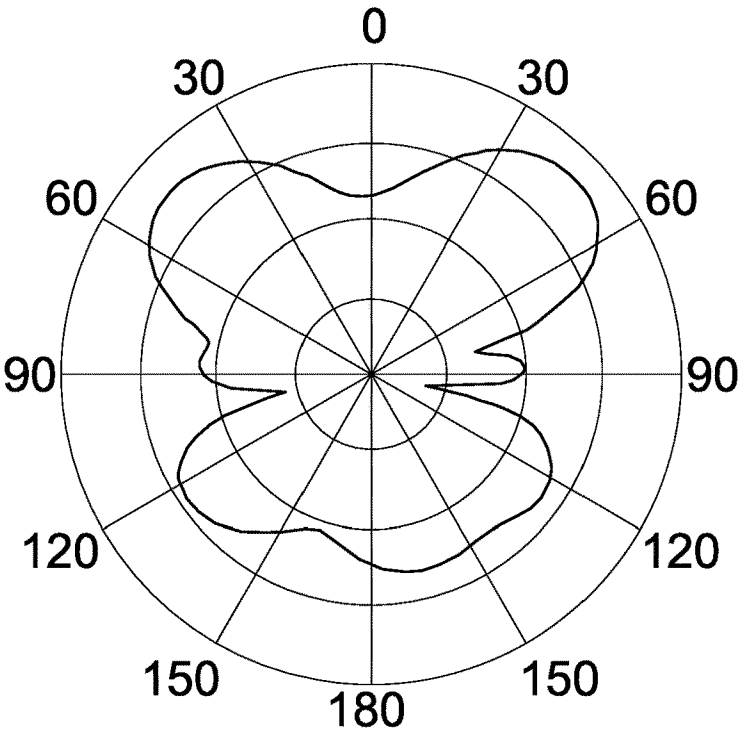
FIG. 7 is a modeled plot of the vertical component of the beam pattern of the FIG. 3 antenna taken at 1850 MHz.

FIG. 7 shows computed pattern behavior for horizontal (ϕ) polarization at a frequency of 1850 MHz, and FIG. 8 shows computed pattern behavior for vertical (Θ) polarization at the same frequency. This pattern behavior, above the 1500 MHz cutoff frequency of the cylinder, verifies that this antenna works properly as a slot antenna. The patterns indicate a stronger horizontal component than a vertical one, which is consistent and expected for a slot antenna. These patterns suggest that the antenna is behaving as a slot antenna above cutoff, which also suggests that the invention is working.

Note that the pattern in FIG. 8 shows that the main beam is elevated above the horizon. This is due in part to the presence of the ground plane which tends to short out the horizontal component hear the horizon and is also due to the long electrical length of the antenna at 1850 MHz. VSWR and realized gain plots of the tested antenna were computed from 0 to 4000 MHz. These also indicate broadband performance with good gain across the band.

The test data presented here show well behaved impedance and pattern behavior in two different bands. This functionality is not available with a straight monopole antenna or straight slotted cylinder antenna.

As an alternative embodiment, ground plane could be made from a solid conductive material. The conductive slotted cylinder could be fastened to ground plane by insulating brackets or other electrically insulated means. One conductor of the feed is provided in an insulated aperture extending through ground plane where it is mounted in electrical connection with the conductive slotted cylinder on a first side of the slot. The second conductor of the feed is mounted in electrical contact with the ground plane. A capacitor or other reactive load component is provided electrically joined to the conductive slotted cylinder on a second sided of the slot opposite the first side. The other pole of the reactive load is electrically joined to the ground plane.

The antenna provided herein can be scaled to other portions of the RF spectrum, making it useful in the realm of commercial communications (e.g., digital television, cellular telephone service, etc.) The geometry and materials involved can readily be adjusted to meet needs in other bands.

Figure 9:
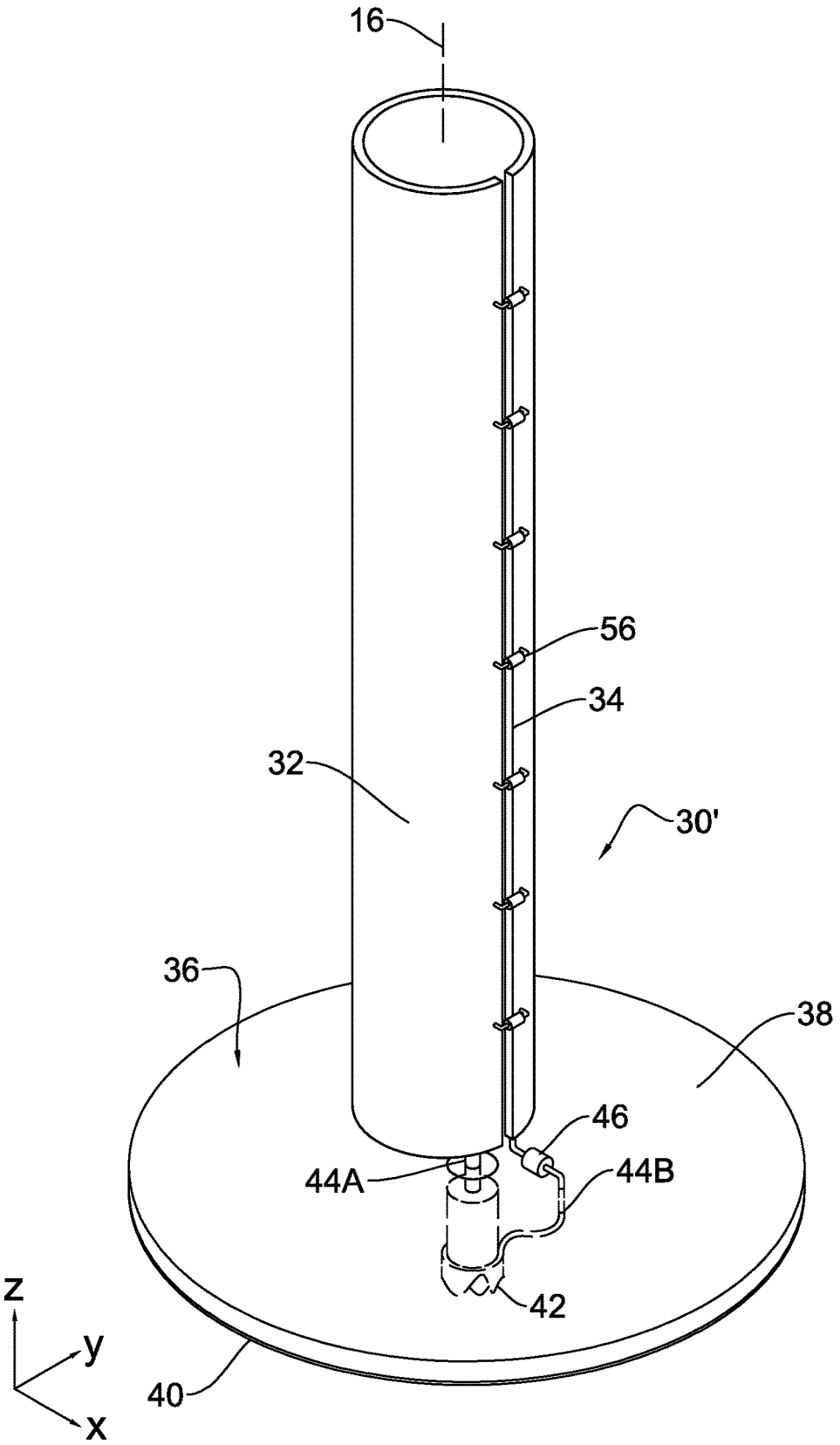
FIG. 9 is an alternate embodiment of an antenna in accordance with the current invention.

FIG. 9 provides an alternate embodiment that improves the impedance match in the portion of the spectrum between the monopole mode passbands. This can be improved by applying distributed reactive loads along the slot. In this embodiment of antenna 30', reactive loads 56, such as capacitors, are positioned at various positions along slot 34. The loading allows the high impedance that the antenna 30' produces in at slot 34 to be lowered by allowing current to "jump" slot 34 at select points along it. This reduces the impedance that appears at the antenna feed and opens up "windows" where the antenna is matched.

It will be understood that many additional changes in the details, materials, steps and arrangement of parts, which have been herein described and illustrated in order to explain the nature of the invention, may be made by those skilled in the art within the principle and scope of the invention as expressed in the appended claims. For example, slotted cylinder 32 can be made from many different conductive materials; likewise, disk 38 can be made from a variety of different materials as long as insulation is provided between the radiator and the ground plane. The middle region of the cylinder can be filled with an insulating material other than air such as syntactic foam.

The foregoing description of the preferred embodiments of the invention has been presented for purposes of illustration and description only. It is not intended to be exhaustive, nor to limit the invention to the precise form disclosed. Obviously, many modifications and variations are possible in light of the above teaching. Such modifications and variations that may be apparent to a person skilled in the art are intended to be included within the scope of this invention as defined by the accompanying claims.

What is claimed is:

1. An antenna, capable of being joined to an antenna feed having a first conductor and a second conductor, comprising:

a non-conductive base having a first side and a second side;

a radiator having a cylindrical wall portion with a slot formed therein from a first end to a second end of the cylindrical wall portion parallel to an axis of the cylindrical wall portion, said radiator being mounted to and extending axially from said non-conductive base first side, said radiator being capable of being electrically connected to the antenna feed first conductor proximate one side of the slot;

a conductive foil positioned on the second side of said non-conductive base and capable of being electrically connected to the antenna feed second conductor, the antenna feed first conductor being electrically isolated from said conductive foil; and a reactive load joined between said conductive foil and said radiator proximate an opposite side of the slot from the location of the antenna feed first conductor.

2. The apparatus of claim 1 further comprising a non-magnetic, dielectric material filling an interior of said radiator defined by the cylindrical wall portion.

3. The apparatus of claim 2 wherein the non-magnetic dielectric material is syntactic foam.

4. The apparatus of claim 2 wherein the non-magnetic dielectric material is air.

5. The apparatus of claim 1 wherein said reactive load has a capacitance value of at least 680 pF.

6. The apparatus of claim 1 wherein said radiator is made from copper.

7. The apparatus of claim 1 wherein said conductive foil is copper foil.

8. The apparatus of claim 7 wherein said conductive foil has a general radius greater than ¼ wavelength of a design frequency of the antenna.

9. The apparatus of claim 1 wherein said non-conductive base is a disk and said radiator is mounted at approximately the center of said non-conductive base.

10. The apparatus of claim 1 further comprising a plurality of distributed reactive loads spaced on said radiator across the slot at various axial distances from said non-conductive base.

11. An antenna capable of being joined to an antenna feed having a first conductor and a second conductor comprising:

a ground plane made from a rigid, electrically conductive material capable of being electrically connected to the antenna feed second conductor, the antenna feed first conductor being electrically isolated from said ground plane;

a radiator having a cylindrical wall portion with a slot formed therein from a first end to a second end of the cylindrical wall portion parallel to an axis of the cylindrical wall portion, said radiator being positioned to axially extend perpendicularly from said ground plane and being insulated from said ground plane, said radiator being capable of being electrically connected to the antenna feed first conductor proximate one side of the slot; and a reactive load joined between said ground plane and said radiator proximate an opposite side of the slot from the location of the antenna feed first conductor.

12. The antenna of claim 11 wherein said ground plane comprises:

a non-conductive base having a first side and a second side, said radiator being mounted on the first side of said non-conductive base; and a conductive foil positioned on the second side of said non-conductive base and capable of being electrically connected to the antenna feed second conductor, the antenna feed first conductor being electrically isolated from said conductive foil.

13. The apparatus of claim 11 further comprising a non-magnetic, dielectric material filling an interior of said radiator defined by the cylindrical wall portion.

14. The apparatus of claim 13 wherein the non-magnetic dielectric material is syntactic foam.

15. The apparatus of claim 13 wherein the non-magnetic dielectric material is air.

16. The apparatus of claim 11 wherein said reactive load has a capacitance value of at least 680 pF.

17. The apparatus of claim 11 further comprising a plurality of distributed reactive loads spaced on said radiator across the slot at various axial distances from said ground plane.

18. A method for receiving lower frequencies in an antenna:

providing a slotted cylinder antenna having a slotted cylinder and a ground plane with one conductor of an antenna feed joined to the slotted cylinder at a first side of a slot and another conductor of an antenna feed joined to the ground plane; and providing a reactive load between the slotted cylinder at a second side of the slot and the ground plane.

19. The method of claim 18 further comprising the step of electrically connecting a plurality of distributed reactive loads across the slot spaced at various axial distances from said ground plane.

* * * * *